United States Patent [19]

Wardlaw

[11] 4,081,039

[45] Mar. 28, 1978

[54] CONNECTING ASSEMBLY AND METHOD

[75] Inventor: Harold W. R. Wardlaw, Houston, Tex.

[73] Assignee: Brown Oil Tools, Inc., Houston, Tex.

[21] Appl. No.: 736,396

[22] Filed: Oct. 28, 1976

[51] Int. Cl.[2] ..... E21B 15/02; E21B 7/12

[52] U.S. Cl. ..... 175/7; 166/.5

[58] Field of Search ..... 166/.5, .6, 86, 46, 166/72.1; 175/7, 6

[56] References Cited

U.S. PATENT DOCUMENTS

| | | | |
|---|---|---|---|
| 3,017,934 | 1/1962 | Rhodes et al. | 175/7 |
| 3,354,951 | 11/1967 | Savage et al. | 166/.6 |
| 3,858,401 | 1/1975 | Watkins | 175/7 |
| 3,885,623 | 5/1975 | Watkins et al. | 175/7 |
| 3,981,357 | 9/1976 | Walker et al. | 175/7 |
| 3,992,889 | 11/1976 | Watkins | 175/7 |

*Primary Examiner*—James A. Leppink

*Attorney, Agent, or Firm*—Browning, Bushman & Zamecki

[57] ABSTRACT

Disclosed is a connecting assembly for communicating between a first location and a second location lower than the first location, with the two locations separated by a fluid body. A first tube extending between the two locations generally encloses a second tube, and the annular area between adjacent surfaces of the two tubes is sealed toward the second location. The buoyancy of the assembly is selectively controlled by selectively controlling the quantity and density of fluid in the area between the tubes. In an embodiment shown, a marine drilling facility is joined to an underwater well site by a riser with a liner set and sealed therein, and gas-lift pumping is used in controlling buoyancy. In the method, a riser is set between an underwater well site and a marine well operating facility. A first segment of the well may be drilled through the riser. Casing is cemented in the well, and a liner is sealed at its bottom end to the riser. Air and jet lines are positioned in the area between the liner and the riser to control the density and quantity of fluid in that area. Continued drilling may occur through the liner and the casing.

34 Claims, 4 Drawing Figures

CONNECTING ASSEMBLY AND METHOD

BACKGROUND OF THE INVENTION

1. Field of the Invention

The present invention relates to apparatus and methods for making underwater connections. More particularly, the present invention pertains to marine riser assemblies with controlled buoyancy, and to methods of assembling and using such riser assemblies in underwater drilling operations.

2. Description of the Prior Art

A marine drilling riser is a conductor pipe used in offshore drilling operations for oil and gas. It is installed between the well site on the underwater floor and the floating drilling vessel or semi-submersible unit. The purpose of the riser is to guide the drill string to and from the well site, and to provide means for circulation for drilling fluid.

The riser constitutes a tubular column. A flexible joint is used to connect the riser to the well site, but generally does not support the riser. If the riser is required to support its own underwater weight, the riser could buckle or bend in deep water situations where a significantly long riser is used. Increasing the diameter of such a riser gives it added strength, but also increases the riser's cross section to currents and wave action.

Various types of tensioners have been proposed and/or employed in attempting to maintain a constant upward pull on the risers to relieve some of the weight supported by them. However, in practice, fluctuations in such upward pull occur as the drilling vessel rises and falls in response to wave action, and the tensioners, whether mechanical or pneumatic, are not always able to respond to such vessel motion rapidly enough to maintian a constant force on the riser.

Another disadvantage of relying solely on tensioners to support the riser is that the supporting force is applied only at the top of the riser. Since the riser is never maintained absolutely vertical, the tensioners should support the weight of the riser plus the weight of the drilling fluid less the weight of the water displaced by the riser. The drilling fluid is distributed along the length of the riser. Consequently, the net buckling load at every point on the riser is generally the sum of the weight of the riser below that point and the weight of the drilling fluid above that point, less the weight of the total volume of water displaced. Additional loading on the riser occurs due to any equipment suspended within the riser and to increase in the density of the drilling fluid column. Then, with tensioners supporting the riser only at the top of the riser where they are anchored on the drilling vessel, the continuously distributed load on the riser can still cause the riser to buckle.

Buoyancy tanks may be attached at one or more points along the length of the riser to provide lift to the riser. However, such tanks added to the riser increase the cross section and, therefore, the resistance of the assembly to currents. Also, to obtain a distribution of increased buoyancy along the riser, multiple tanks must be provided. Furthermore, once these tanks are installed, the buoyancy provided by the tanks cannot be adjusted to suit environmental or other condition changes. Thus, the danger of a positive buoyancy coupled with a break in the riser cannot be met by reducing the buoyancy so as to prevent the sudden rise of the riser assembly and its possible collision with the drilling vessel.

An additional disadvantage of fixed-buoyancy riser assemblies is experienced when, in the event of a threatened storm or rough water conditions, the riser assembly is disconnected at the well site. However, with fixed, slighly negative buoyancy, the disconnected riser will then weave below the vessel, making manipulation of the riser difficult.

Foams may be utilized as flotation material to add buoyancy to a riser. However, such a technique is but another form of fixed buoyancy method. In addition, foams tend to take on water when subject to undersea pressures, thereby reducing their effectiveness.

U.S. Pat. No. 3,858,401 discloses a system of open-bottomed buoyancy chambers surrounding the riser at various levels. Gas under pressure is fed into each chamber to displace sea water therefrom. A separate valve, actuated to close when a predetermined level of water is reached in the respective chamber, controls the flow of gas into that chamber. Gas removing means, such as a bleed line, can be used to reduce the buoyancy of each chamber. These buoyancy chambers, like the buoyancy tanks described hereinbefore, present an enlarged cross section to currents, and, as longer risers are used, more such chambers are needed.

Since the load on the riser at any point depends on the drilling fluid weight, the load on the riser can be reduced at virtually all points by lowering the density and/or quantity of drilling fluid contained within the riser. U.S. Pat. No. 3,434,550 discloses a system whereby the drilling fluid circulating upwardly within the annular region between the riser body and the drill pipe contained therein may be aerated to lower the fluid density. In this manner, the hydrostatic head of the drilling fluid in that annular region may be reduced to lighten the load on the riser. However, the system of that patent employs one or more gas manifolds external to the riser, and exposed to the currents. Furthermore, to maintain a constant buoyancy of the riser, gas must continuously flow through the circulating drill fluid.

SUMMARY OF THE INVENTION

Apparatus of the present invention include a riser in the form of a tubular member extending from a surface drilling facility, or vessel, down to a well site on the sea bottom. The riser is connected by a universal joint to the well site. A slip joint connects the top of the riser to the drilling facility. A liner, extending generally the length of the riser, is set within the riser. A liner hanger may be used to fasten the liner top end to the interior of the riser in the vicinity of the drilling facility. A packer, or other sealing device, seals the liner near its bottom end to the interior surface of the riser in the vicinity of the well site. The liner may also be sealed to the riser at the top end of the liner. An additional variation includes hanging the liner at any point below the top of the riser.

The liner may be selected to have a diameter equal to the diameter of protective casing cemented in the first segment of the well to be drilled. Since this linear diameter is necessarily smaller than the interior diameter of the riser, a generally annular area is defined between the outer surface of the liner and the inner surface of the riser, with a bottom determined by the aforementioned packer, and with a top end near the liner top. Material within this annular region may be removed only from the top thereof, that is, at the drilling facility end.

A pair of tubes extends down into the annular area from the drilling facility to the region just above the packer. These tubes include a gas inlet line and a jet line.

The lower end of the gas line is turned upwardly and dovetails with the flared, downwardly directed end of the jet line.

During the setting of the liner within the riser, fluid, such as drilling mud and/or sea water, is trapped in the annular region above the packer. The weight of the entire assembly may be altered by thereafter controlling the amount and density of this trapped fluid. In general, removing a quantity of this fluid from the annular area increases the buoyancy of the entire riser assembly. To effect such removal, gas, such as air, is forced down the gas inlet tube to be bubbled into the jet line. The jet line contains a quantity of the trapped fluid. Gas bubbles moving up through this fluid in the jet line decrease the density of the fluid, causing it to be pushed up the jet line by more dense fluid entering through the flared bottom of the jet line. In this way, fluid may be selectively removed from the annular area by control of the input of the gas into the gas inlet line. If necessary, gas lift valves may be used to join the gas inlet line to the jet line at positions along the riser to further decrease the density of the fluid contained in the jet line. Also, by permitting introduction of gas at higher positions along the jet line, such gas lift valves make it possible to manipulate liquid in long riser assemblies, or relatively dense liquids, without the need of a large pressure gas source at the drilling facility. Additional pairs of gas inlet and jet lines may be placed within the annular region for increased buoyancy control. Also, if it becomes necessary to decrease the buoyancy of the riser assembly, additional fluid may be introduced into the annular region by reverse pumping such fluid down the jet line. A check valve at the lower end of the gas inlet line prevents the fluid from entering the inlet line.

After a section of the well has been drilled and lined with casing, a drill bit of diameter smaller than that of this casing must be used for continued drilling. Before such drilling is resumed, however, the liner may be replaced in the riser by one of smaller internal diameter, i.e. a diameter just large enough to accomodate the smaller drill bit. Such a reduction in liner size can be effected whenever the drill bit size is reduced to pass through casing set in the well. An advantage of using the smallest diameter liner possible is that the weight of the liner, which contributes to the load on the riser, is kept to a minimum.

In the method of the invention, a riser tube is extended from a drilling facility on the surface of a body of water down to an underwater well site. The riser tube is appropriately set, flexibly coupled to the drilling facility at the top end and to the well site at the bottom end. A first segment of the well is drilled by passing a drill string with a drill bit down through the riser. Then, casing is passed down through the riser, and cemented into place in this first segment in a manner well known in the art. A liner, of diameter equal to the casing diameter, is set within the riser. The liner is hung from adjacent the top of the riser, and a packer or other sealing device is set between the liner and the riser near the base of the liner. Continued drilling of the well, with a smaller diameter drill bit, can take place through the liner and casing that has been cemented in the first well segment.

A variation of the method includes drilling the first well segment through a liner within a riser. In such a case, this liner would be the same diameter as the riser used without a liner for drilling the first well segment, if the drill bit size for the first well segment is the same. Then a larger diameter riser would be needed. The advantage of this variation, however, is that the buoyancy of the riser assembly may be controlled from the start of the operation. The control may be especially important where the well is in deep water.

The fluid that is trapped between the liner and the riser above the packer may be removed from that region, or decreased in density, to increase the buoyancy of the entire assembly as needed. Furthermore, additional fluid may be pumped down into the region to decrease the buoyancy as needed.

As the well is drilled, additional casing members may be lowered through the liner and cemented in place below the first casing in the first well segment. The subsequent casing members are of smaller diameter than the original casing, being able to pass down through the liner that is set within the riser. Similarly, as the well is dug to a deeper level, the diameter of the drill bit must be reduced. The ability of the drilling mud in the well to counter deep hole formation pressure is not affected by the decreasing diameter of the well bore itself. As each additional casing segment is cemented in place in the well, a new liner, of diameter equal to that of the last cemented casing, may, if needed, be set within the riser, replacing a prior larger diameter liner. Each new liner in turn is sealed to the riser with a packer, and provision is made for removing fluid from, or adding fluid to, the annular region formed between the liner and the riser. Consequently, as drilling progresses, and the density of drilling mud used is increased to accommodate greater downhole pressures, the buoyancy of the riser assembly continues to be selectively controlled. The total amount of fluid that may be removed from the annular region between the liner and riser thus defined within the riser assembly increases as the liner diameter decreases, and the annular region covers a greater amount of the riser assembly transverse cross section available for buoyancy control.

The apparatus and method of the present invention provide riser assemblies with several distinct advantages. Such an approach to underwater drilling permits the drilling to proceed with the minimum weight of the mud column in the riser, since the liner installed within the riser may be changed following the running and setting of casing, allowing the minimum diameter liner to be used at all times. Furthermore, it is possible to use a liner of a diameter smaller than the last set casing, and to drill with a correspondingly smaller drill bit in conjunction with an underreamer to continue the well bore below the last set casing. With such extensive control over the quantity and density of fluid trapped in the annular region described hereinbefore, the drilling operation may proceed with the riser assembly under positive, neutral or negative buoyancy as desireable under various environmental and other conditions. The steps of the present method, as well as the apparatus employed, occur generally within the lateral dimensions of an ordinary riser tube. Consequently, the present invention does not generally increase the cross section of the riser assembly exposed to currents and wave action. If desired, the riser may additionally be secured to the sea floor by anchors to further prevent a possible undesired surfacing of the riser under positive buoyancy conditions should the riser inadvertently be broken. Finally, use of the minimum size liner within the riser allows high upward velocity of drilling fluid to be maintained by keeping the cross section of such fluid flow up the liner to a minimum size.

It will be appreciated that the method and apparatus of the present invention can be used to control the buoyancy of a riser assembly at any time during operations between a drilling vessel and an underwater well site as well as when disconnected from the well site. Thus, positive buoyancy may be attained for simply supporting the riser assembly during routine drilling or when disconnected. When the riser is disconnected from the well site in the event of a threatened storm, negative buoyancy may be used to keep the riser assembly positioned below the drilling vessel, without weaving or extreme motion of the riser. Negative buoyancy may also be used as a safety feature when the drill string is being run in or out of the well bore. The buoyancy of the riser assembly may be controlled and altered over a wide range of values, generally positive, neutral and negative, as required. The buoyancy may be changed at will, and as fast as the appropriate fluid pump systems can operate to add gas or liquid to the riser. Once a buoyancy value is achieved, it may be maintained without continued pumping of gas or liquid to do so.

DESCRIPTION OF THE PREFERRED EMBODIMENTS

Figure 1:
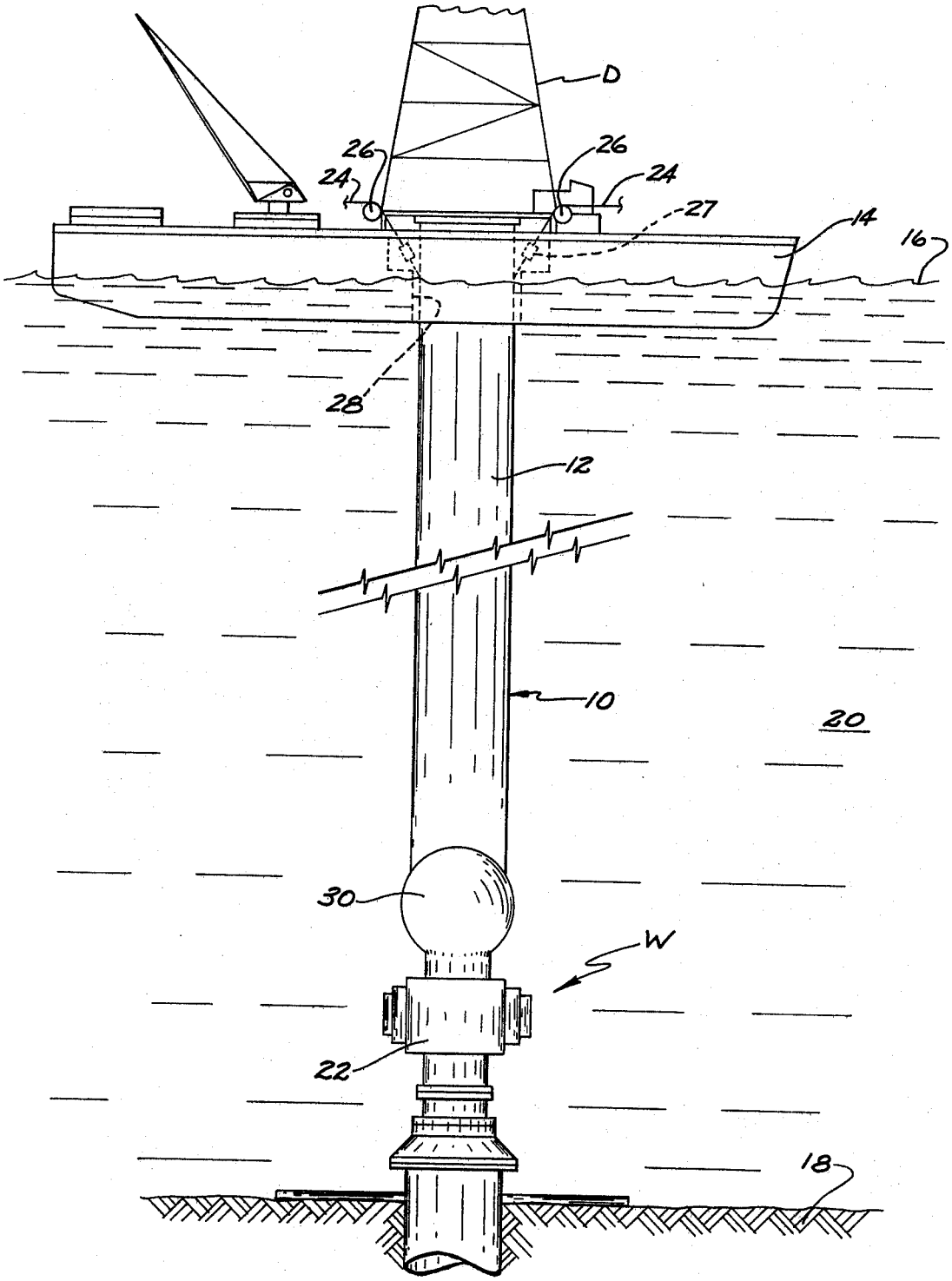
FIG. 1 is a partial, schematic side elevation showing the type of riser tube used in the present invention extending from a drill ship down to a well site on the sea bottom.

The riser assembly of the present invention is shown generally at 10 in FIGS. 1 through 4. In FIG. 1, a riser, or riser tube, 12 is shown extending from a drill ship, or other marine well operating facility, 14 at the water surface 16 down to a well site, shown generally at W, on the floor 18 of the body of water 20. A blowout preventer 22 is shown fixed to the well head. The drill ship 14 is fitted with a derrick D and other pertinent well-working paraphenalia known in the art. Cables 24 are fixed to the riser 12 near its top end, and pass over sheaves 26 to anchoring devices (not shown). The cables 24 may be operated on winches, or tensioning devices, to maintain the top of the riser at a desirable and workable elevation relative to the drill ship 14, while accommodating the rises and falls of the drill ship due to wave and tidal action. The cables 24 also support the weight of the riser assembly 10, and maintain tension along the riser to prevent its buckling. Tensioners 27 are integrated in the cables 24 to act as shock absorbers between the ship 14 and the pull of the riser assembly as the ship responds to wave action. The riser 12, as well as other equipment to be passed down to the well site W, passes through a passage 28 extending through the bottom of the ship. Additional details of the drill ship 14 and its related equipment are well known in the art, and are otherwise not relevant to the present invention. Also, a semi-submersible drilling facility, or even a drilling platform, may be used with the invention in place of the drill ship 14.

Figure 2:
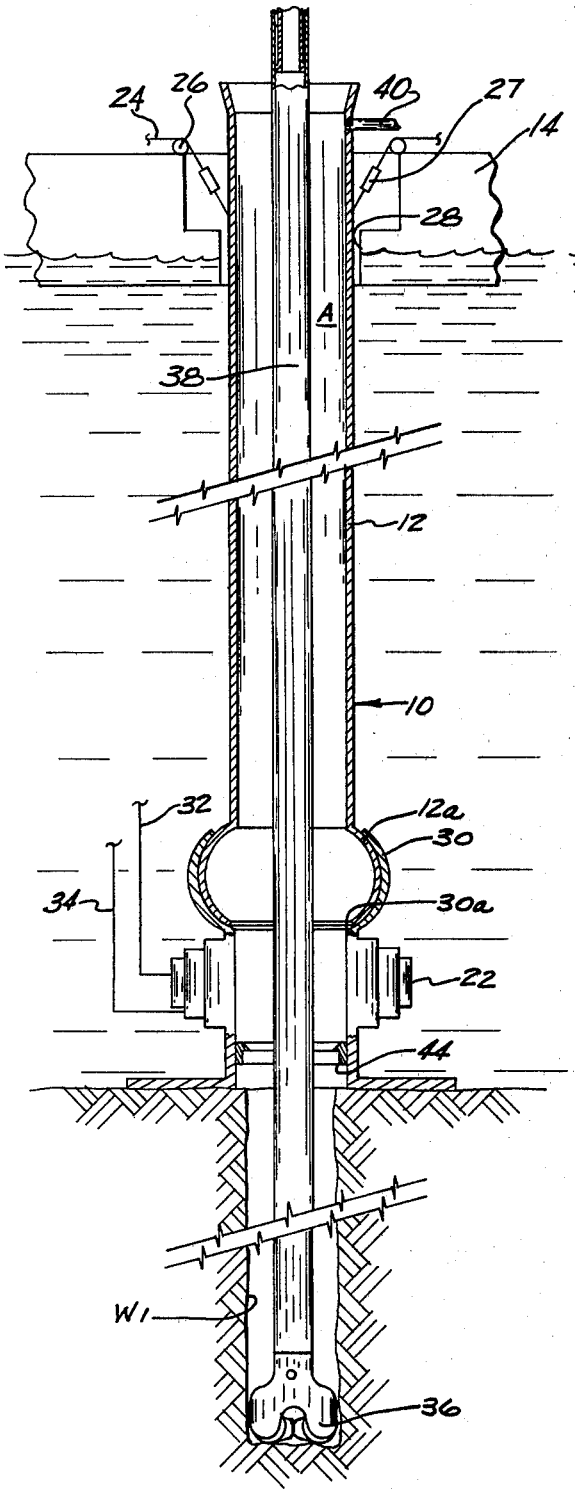
FIG. 2 is a partial cross sectional view, partly schematic, showing a riser with a first well segment being drilled through the riser.
Figure 3:
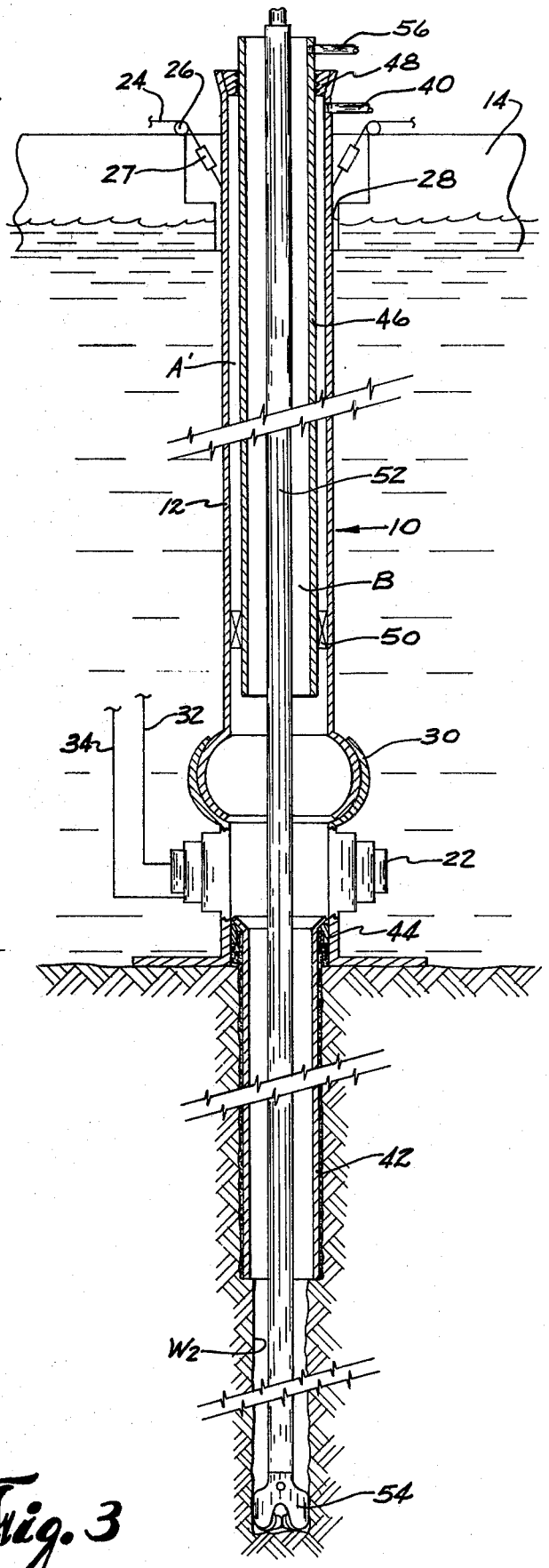
FIG. 3 is a view similar to FIG. 2, but showing continued drilling of the well bore with a smaller drill bit having passed through a liner set and sealed within the riser, and a casing member cemented in place in the first well segment.
Figure 4:
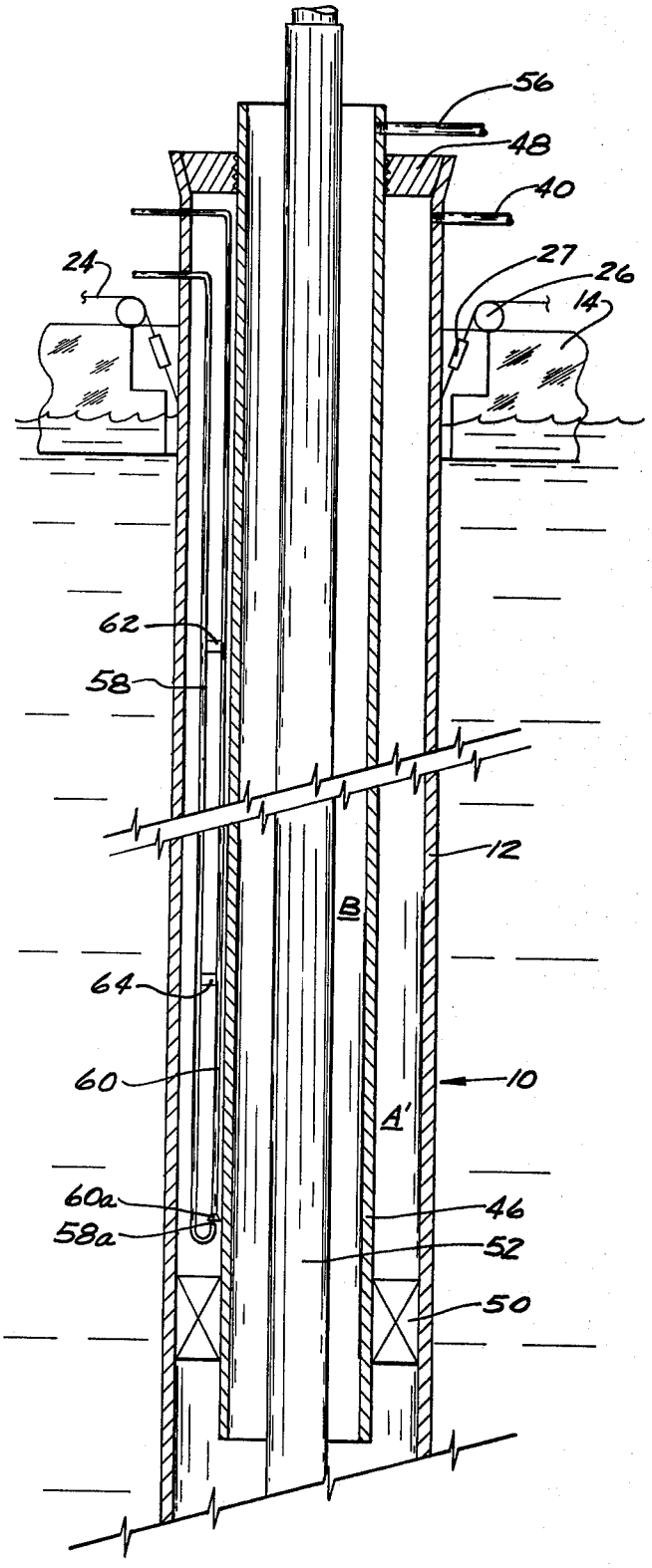
FIG. 4 is an enlarged partial cross sectional view of the riser and liner of FIG. 3, but showing also the gas inlet line and the jet line.

A universal joint 30 provides a flexible anchoring for the riser 12 at the well site W, as best seen in FIGS. 2 and 3. This universal joint 30 is generally of a ball-and-socket type, with an extension 12*a* of the riser 12 acting as a ball fitted within the curved outer restraints of the socket. Any appropriate type of universal joint may be used provided a passage 30*a* is available for passing equipment down through the joint 30, and provided the joint permits the riser 12, and equipment suspended therefrom, to be able to tilt in all directions relative to the vertical.

The blowout preventer 22 is connected to the drill ship by a kill line 32, and a choke line 34, both well known in the art. The blowout preventer 22 is designed to automatically seal off the annular space surrounding the drill string if the down hole pressure rises above a predetermined level. Then, if necessary, the kill line 32 may be used to pump fluid down the annular space into the well bore to keep that annular region full of fluid, or, if needed, the choke line 34 may be used to circulate fluid from the bottom of the annular space in the riser to the drill ship if the pressure in the riser column has increased beyond a predetermined level. The blowout preventer 22, kill line 32 and choke line 34 are safety devices used in drilling operations, but otherwise irrelevant to the present invention.

In FIG. 2, a first segment of the well bore W1 is shown being drilled with the use of a drill bit 36 being driven by a drill string 38. Drilling fluid or mud is passed down through the interior of the drill string 38 and out through the drill bit 36 to be circulated back toward the drill ship 14. This drilling fluid passes through an annular region A between the exterior surface of the drill string 38 and the interior surface of the riser 12. A conduit 40 is provided at the top of the riser 12 to remove the circulated drilling fluid from the riser. As in other drilling operations, the drilling fluid serves the purpose of washing out cut material from the well bore and providing hydrostatic pressure to overcome downhole formation pressures to prevent a blowout.

FIG. 3 illustrates the drilling of a second well bore segment W2 of a diameter smaller than that of W1. Casing 42 has been cemented in place to line the first well bore segment W1. The well head is fitted with a casing hanger 44 (see FIG. 2) to support the casing 42 until the cementing operation is completed. This cementing operation may be performed by use of a cementing tool (not shown) temporarily supported by a hanger within the casing 42. Such operation is well known in the art, and neither the cementing method nor the particular apparatus used therein is further discussed herein.

With the casing 42 cemented in place, a liner 46 is set within the riser 12 as shown in FIG. 3. A liner hanger 48 supports the liner from the top of the riser 12, and a packer, or other sealing device, 50 seals the liner 46 to the riser toward the lower end of the liner. The liner hanger 48 may also seal the liner 46 to the riser 12. The sealing between the liner 46 and the riser 12 may also be achieved with the use of a polished bore receptacle. Thus, the annular area A is reduced in cross section to an area A′, and is closed at the bottom by the packer 50, while the conduit 40 still provides a means for communication external to the riser 12. A new annular area B is now defined between the interior surface of the liner 46 and the exterior surface of a new drill string 52.

The drill string 52 may be of smaller diameter than that of the drill string 38 previously employed. A drill bit 54 is operated at the bottom of the drill string 52. This drill bit 54 is of small enough cross section to be passed through the casing 42. The reduction in size in the drill bit 54 compared to the first drill bit 36 makes it possible to use a liner 46 that is equal in diameter to the casing 42. A larger diameter liner would be heavier than the liner 46. Thus, the drill bit size places a lower limit on the diameter of the liner that may be used, and thereby controls the possible reduction of weight of the riser assembly 10.

As the second well bore segment W2 is being drilled, drilling fluid is passed down the drill string 52 and out through the drill bit 54. This drilling fluid passes up through the casing 42 and the liner 46. A conduit 56 provides means for tapping this drilling fluid from the interior of the liner 46.

It will be appreciated that the drilling of the first well bore segment W1 may be performed through a liner within the riser 12, as shown in FIG. 3. Then, the liner used would have to be of sufficient diameter to allow passage therethrough of the drill bit 36. To accommodate such a large liner, the diameter of the riser 12 might have to be increased.

It may be appreciated that, as the drilling progresses to greater depth, it generally becomes necessary to provide increased pressure with the drilling fluid to balance formation pressures of greater quantity. However, by circulating the drilling fluid to the greater depth of FIG. 3 through a narrower drill string 52 and the liner 46, the total weight of the drilling fluid being circulated within the riser assembly 10 may be made smaller than the weight of the drilling fluid circulation down the drill string 38 and up through the annular area A as shown in FIG. 2. This reduction in weight of circulated drilling fluid being enclosed within the riser assembly 10 is achieved by simply reducing the total cross sectional area of the drilling fluid column. This decrease in circulated drilling fluid supported by the riser assembly 10 does not reduce the hydrostatic head available at the downhole location of the drill bit 54, for example, since this pressure depends upon the height of the drilling fluid column, and not its transverse cross sectional area.

When the liner 46 is set and sealed within the riser 12, drilling fluid may be trapped within the annular region A'. Also, some sea water may remain in this area, having been trapped therein when the riser 12 was originally set and joined to the universal joint 30. The disposition of the combined fluid within the annular region A' may best be appreciated by reference to FIG. 4. A gas inlet line 58 and a jet line 60 enter the riser 12 at the drill ship, and extend down into the area A' to the vicinity of the packer 50. The jet line 60 ends in a flared opening **60*a* facing downwardly. The gas inlet line 58 curves 180° to face upwardly, with its end 58*a* aligned with and facing the flared jet line opening 60*a*. A check valve (not shown) is fitted to the gas inlet line end 58*a* to prevent drilling fluid and sea water from backing into the gas inlet line 58**.

With the jet line 60 in position in the annular area A', drilling fluid and sea water contained therein may pass up the flared opening **60*a* into the interior of the jet line. When it is desired to reduce the total weight supported by the riser assembly 10, gas, such as air or some inert gas, may be pumped down the gas inlet line 58 from the drill ship. This gas emerges through the check valve in the bottom end 58*a* of the inlet line, enters through the flared jet line opening 60*a* and bubbles up through the fluid contained in the jet line 60. The fluid within the jet line 60 decreases in density due to the action of the gas bubbles, and is forced up through the jet line by more dense fluid entering the flared opening 60*a* under influence of the hydrostatic pressure of the annular fluid column contained within the area A'. The fluid so propelled up the jet line 60 may be removed from the riser assembly 10 at the drill ship. Thus, by controlling the pumping of gas into the gas inlet line 58, fluid may be selectively removed from the annular area A' with the result that the buoyancy of the riser assembly 10 may be increased. If necessary, fluid may be added to the annular area A', either through the conduit 40, or by reverse pumping fluid down the jet line 60. Thus, the buoyancy of the riser assembly 10** may be selectively increased or decreased.

Gas lift valves, indicated schematically at 62 and 64, provide additional passageways to introduce gas from the gas inlet line 58 to the jet line 60. Although only two such gas lift valves 62 and 64 are shown, additional gas lift valves may be used where the length of the gas inlet line 58 and that of the jet line 60 warrant. Each gas lift valve is adjusted to permit gas transmission to the jet line in response to the hydrostatic pressure in the jet line falling below a preselected value at the location of that gas lift valve. The higher the gas lift valve is located, the lower is the pressure value to which the particular valve is adjusted to so respond. Consequently, the gas lift valves are adjusted so that, when gas is pumped down the gas inlet line 58 to lower the liquid density in the jet line 60, the highest gas lift valve 62 opens first to transmit the gas to the jet line. Then, as the liquid toward the top of the jet line 60 lowers in density, and the hydrostatic head at every point in jet line 60 is lowered, the next gas lift valve down the jet line, here, 64, opens. The gas lift valves continut to respond in this order as the hydrostatic pressure in the jet line 60 continues to fall until the gas from the gas inlet line 58 can bubble out of the check valve (not shown) at the inlet line end **58*a*, through the liquid at that location, and into the flared jet line end 60*a***. Gas lift valves are well known, and will not be further described herein.

Such use of gas lift valves permits the lowering of liquid density by gas lift when the hydrostatic pressure in the jet line is large without the need for raising the gas pressure at the gas inlet line end **58*a* to match the level of the liquid pressure at that point before the density of the liquid is at all lowered. A relatively long column of liquid in the jet line 60**, and/or high density liquid in the jet line, could cause such high pressures as to require the use of gas lift valves, or a high pressure pump.

The method of the present invention may be appreciated with reference to FIGS. 1–4. A riser 12 is flexibly joined at a submerged well head W, and to a drilling facility 14 at or near the water surface 16. Support apparatus, such as cables 24 and tensioners 27, act to keep the riser 12 under tension. A drill string 38 is passed down through the riser 12 to be used to drive a drill bit 35 to drill a well segment W1. The drill string 38 is withdrawn, and the well segment W1 is lined with cemented casing 42. A liner 46 is hung in the riser 12, and sealed to the riser near the bottom of the liner 12. A second drill string 52, narrower than the first drill string 38, is passed down the liner 46 to drive a drill bit 54 to continue drilling the well. Drilling the first well segment W1 through such a liner hung in the riser is an alternative step to initially drilling only through the riser.

As the drilling progresses, the well bore may continue to be lined with cemented casing. Also, progressively smaller drill bits may be used, thus making the deepening well bore of decreasing diameter, and allowing the liner hung in the riser 12 to be replaced with liners of smaller diameters.

During the drilling operation, drilling fluid is circulated down the drill string, out through the drill bit, and up the well bore to the riser 12. This drilling fluid serves to wash out cut material, and to balance the down hole pressure. Before the liner 46 is hung and sealed to the riser 12, the circulated fluid passes up the annular region A between the drill string 38 and the riser. Once a liner 46 is in place in the riser, the drilling fluid and cuttings pass up the annular region B between the drill string 52 and the liner 46.

Fluid trapped in the annular region A' between the liner 46 and the riser 12 when the seal 50 is set at the bottom of the liner is lowered in density and/or removed from that region to increase the buoyancy of the assembly. To lower that buoyancy, more fluid is added to that annular region. Gas lift, including operation of gas lift valves, is used to aerate the fluid within a jet line 60, to lower its density, thereby permitting larger density fluid in the annular region A' to force the liquid in the jet line upwardly, and eventually out of the annular region. The buoyancy of the assembly may then be made and maintained at any value ranging from the positive, through neutral, to the negative.

Although the present invention is particularly shown herein as applied to underwater well drilling operations, the method and apparatus of the present invention may be used generally to connect any two locations between which a body of fluid is located. Thus, for example, a tube or a pipe line may be extended between two locations underwater, in the place of the liner described herein, and surrounded by a second tube or pipe in the place of the riser. Then, the density and/or amount of liquid in the generally annular region between the pipeline and the outer pipe may be adjusted to control the buoyancy of the entire assembly.

The foregoing disclosure and description of the invention is illustrative and explanatory thereof, and various changes in the method steps as well as in the details of the illustrated apparatus may be made within the scope of the appended claims without departing from the spirit of the invention.

I claim:

1. A riser assembly for connecting a marine well operating facility with a well site which is submerged in water comprising:

(a) riser tube means having a first end flexibly joined to said operating facility and a second end flexibly joined to said submerged site;

(b) liner means, set generally within said riser tube means, having a first end and a second end generally toward said first end and said second end of said riser tube means respectively, and, with said riser tube means, defining a generally annular region between the radially inner surface of said riser tube means and the radially outer surface of said liner means with a first end of said region generally toward said first end of said liner means;

(c) seal means for fluid sealing said liner means to said riser tube means generally toward said second end of said liner means, thereby defining a second end of said generally annular region; and (d) gas input means for selectively introducing gas into said generally annular region for generally increasing the buoyancy of said riser assembly by decreasing the density or the amount, or both, of liquid in said region.

2. A riser assembly as defined in claim 1 further comprising gas lift valve means, included in said gas input means.

3. A riser assembly as defined in claim 1 wherein said gas input means includes:

(a) jet line means extending into said generally annular region for providing means of egress of fluid from within said region; and (b) gas inlet line means extending into said region for introducing gas into said jet line means for decreasing the density of liquid within said jet line means.

4. A riser assembly as defined in claim 3 wherein said jet line means includes a flared end within said generally annular region, and said gas inlet line means includes, within said region, an end having a check valve for preventing liquid from entering said gas inlet line at said end, and which gas inlet line means end is positioned adjacent said jet line means flared end for directing gas flow from said gas inlet means end into said jet line means flared end.

5. A riser assembly as defined in claim 4 further comprising gas lift valve means, included in said gas input means, connecting said gas inlet line means with said jet line means at at least one position within said generally annular region for selectively transmitting gas from said gas inlet line means to said jet line means.

6. A riser assembly as defined in claim 5 further comprising liquid input means for selectively introducing liquid into said generally annular region for generally decreasing the buoyancy of said riser assembly.

7. A riser assembly as defined in claim 5 further comprising well drilling equipment for drilling a well bore at said submerged site by extending said well drilling equipment through said liner means to said submerged site.

8. A riser assembly as defined in claim 7 wherein said well drilling equipment includes:

(a) drill string means for extending from said operating facility through said liner means to said submerged site, and into said well bore being drilled; and (b) drill bit means, driven by said drill string means, for drilling said well bore.

9. A riser assembly as defined in claim 8 wherein said well drilling equipment further includes well casing means for lining said well bore.

10. A riser assembly as defined in claim 9 further comprising liquid input means for selectively introducing liquid into said generally annular region for generally decreasing the buoyancy of said riser assembly.

11. A riser assembly as defined in claim 3 further comprising liquid input means for selectively introducing liquid into said generally annular region for generally decreasing the buoyancy of said riser assembly.

12. A riser assembly as defined in claim 3 further comprising well drilling equipment for drilling a well bore at said submerged site by extending said well drilling equipment through said liner means to said submerged site.

13. A riser assembly as defined in claim 12 wherein said well drilling equipment includes:

(a) drill string means for extending from said operating facility through said liner means to said submerged site, and into said well bore being drilled; and (b) drill bit means, driven by said drill string means, for drilling said well bore.

14. A riser assembly as defined in claim 13 wherein said well drilling equipment further includes well casing means for lining said well bore.

15. A riser assembly as defined in claim 1 further comprising liquid input means for selectively introducing liquid into said generally annular region for generally decreasing the buoyancy of said riser assembly.

16. An assembly for communicating a first location with a second location, wherein said assembly extends through a body of fluid, comprising:

(a) first tube means extending continuously generally between said first location and said second location;

(b) second tube means, set generally within said first tube means, and, with said first tube means, defining an area generally between the inner surface of said first tube means and the outer surface of said second tube means;

(c) seal means for closing off said area toward the end of said second tube means toward said second location;

(d) fluid means; and (e) pump means for selectively adjusting and maintaining said fluid means in said area in quantity and density to selectively control the buoyancy of said assembly relative to said fluid body.

17. A method for providing a connection between a first location and a second location, between which locations a body of fluid is located, comprising the steps of:

(a) extending a first tube means between said first location and said second location, through said body of fluid;

(b) setting a second tube means generally within said first tube means, thereby defining an area generally between the inner surface of said first tube means and the outer surface of said second tube means;

(c) fluid sealing said second tube means to said first tube means generally at the end of said second tube means that is generally toward said second location, thereby defining one end of said area; and (d) selectively controlling the density and amount of liquid in said area by pumping liquid into or out of said area at the opposite end of said area.

18. A method of providing a connection between a first location and a second location as defined in claim 17 further comprising the step of selectively pumping liquid out of said area by pumping gas into said area to aerate said liquid, thereby decreasing its density to permit larger density liquid in said area to force the resulting lower density liquid out of said area.

19. A method of operating on an underwater well from a marine drilling facility comprising the steps of:

(a) flexibly joining a riser tube at the drilling facility and at the well site;

(b) drilling a segment of the well bore by passing a drill string and a drill bit down through the riser tube from the drilling facility, and driving the drill bit by the drill string through the riser tube;

(c) setting a liner within the riser tube by hanging the liner from generally toward the drilling facility;

(d) fluid sealing the liner to the inner surface of the riser tube generally at the lower end of the liner, thereby defining a generally annular region between the outer surface of the liner and the inner surface of the riser, extending from the fluid seal up generally toward the drilling facility; and (e) selectively controlling the buoyancy of the combination of the riser tube and its contents by adjusting the density or the amount, or both, of liquid within the generally annular region.

20. A method of operating on an underwater well from a marine drilling facility as defined in claim 19 further comprising the step of selectively introducing gas into the generally annular region to gas lift liquid from that region to selectively increase the buoyancy of the riser tube and its contents.

21. A method of operating on an underwater well from a marine drilling facility as defined in claim 20 further comprising the step of selectively adding liquid to the generally annular region to selectively decrease the buoyancy of the riser tube and its contents.

22. A method of operating on an underwater well from a marine drilling facility as defined in claim 19 further comprising the steps of:

(a) providing a jet line extending from the area of the drilling facility drown into the generally annular region, and having a flared, open bottom end;

(b) providing a gas inlet line extending from the area of the drilling facility down into the generally annular region, and having a check valve at the bottom end, directed to permit gas to flow out of the gas inlet line into the flared end of the jet line, but preventing liquid flow into the gas inlet pipe; and (c) selectively pumping gas down the gas inlet line to flow into the jet line, to aerate the liquid containing therein to lower the density of said liquid.

23. A method of operating on an underwater well from a marine drilling facility as defined in claim 22 further comprising the step of selectively continuing to pump gas down the gas inlet line to flow into the jet line to aerate the liquid contained therein to lower the density of said liquid until higher density liquid, entering the jet line through its flared, open end, propels liquid of lower density up the jet line and of the generally annular region.

24. A method of operating on an underwater well from a marine drilling facility as defined in claim 23 further comprising the steps of:

(a) providing selective gas flow means between the gas inlet line and the jet line above the ends of both within the generally annular region; and (b) selectively transmitting gas from said gas inlet line through said selective gas flow means to said jet line for selectively reducing the density of liquid in the jet line.

25. A method of operating on an underwater well from a marine drilling facility as defined in claim 23 further comprising the steps of:

(a) lining said well bore with casing as segments of the well bore are drilled;

(b) replacing the liner, hung and sealed within the riser tube, by a liner of smaller diameter after a well bore segment is lined with casing; and (c) drilling subsequent well bore segments with a drill bit of narrower cross section after the replacement of the liner.

26. A method of operating on an underwater well from a marine drilling facility as defined in claim 25 further comprising the steps of:

(a) setting a liner within the riser tube, and fluid sealing the liner to the riser tube before drilling the first segment of the well bore; and (b) drilling the first segment of the well bore by driving a drill bit with a drill string passing through this liner while maintaining control of the buoyancy of the riser tube and its contents by adjusting the density or amount, or both, of liquid within the region between this liner and the riser tube.

27. A method of operating on an underwater well from a marine drilling facility as defined in claim 22 further comprising the steps of:

(a) further drilling the well bore by driving a drill bit with a drill string passing through the liner; and (b) progressively lining the well bore with casing.

28. A method of drilling an underwater well from a marine drilling facility comprising the steps of:

(a) connecting the drilling facility with the well site by a riser tube, flexibly joined to the drilling facility at the top of the riser tube, and flexibly joined to the well site at the bottom of the riser tube;

(b) setting a liner generally within the riser tube by hanging the liner adjacent the top of the riser tube and fluid sealing the liner to the riser tube adjacent the bottom of the liner, thereby defining a generally annular region between the inner surface of the riser tube and the outer surface of the liner, extending from the location of the fluid sealing adjacent the bottom of the liner up to the vicinity of the drilling facility;

(c) providing a jet line extending down into the generally annular region, and ending in a flared opening;

(d) providing a gas inlet line extending down into the generally annular region, fitted with a check valve to prevent liquid from flowing into the gas inlet line from the region, and with its lower end directed toward the flared open end of the jet line;

(e) controlling the buoyancy of the riser tube and its contents by selectively pumping gas down the gas inlet line to flow through the check valve and out the gas inlet line lower end into the flared open end of the jet line to aerate liquid within the jet line to permit said aerated liquid to be propelled up the jet line by liquid of larger density entering the jet line through its flared open end from within the region;

(f) drilling the well bore by a drill bit driven from the drilling facility by a drill string extending from the drilling facility down, through the liner, to the well site; and (g) circulating drilling fluid from the drilling facility down through the drill string, out into the well bore, up through the liner surrounding the drill string, back to the drilling facility.

29. A method of drilling an underwater well as defined in claim 28 further comprising the steps of:

(a) lining the well bore with casing after a segment of the well bore has been drilled;

(b) replacing the liner with a subsequent liner of smaller diameter, set within the riser tube by hanging and fluid sealing; and (c) drilling a subsequent segment of the well bore with a subsequent drill bit of small lateral cross section driven by a subsequent drill string of smaller diameter, passing through the subsequent liner.

30. A method of drilling an underwater well as defined in claim 29 further comprising the steps of repeating the steps of lining the well bore with casing, replacing the liner with one of smaller diameter set within the riser tube, and further drilling the well bore with a drill bit of reduced cross section, driven by a drill string, of reduced diameter, passing through the liner of smaller diameter.

31. A method of drilling an underwater well as defined in claim 30 further comprising the step of further controlling the buoyancy of the riser tube and its contents by selectively adding liquid to the generally annular region.

32. A method of drilling an underwater well as defined in claim 31 further comprising the steps of:

(a) providing at least one gas lift valve connecting the gas inlet line with the jet line above the flared open end of the jet line; and (b) further controlling the buoyancy of the riser tube and its contents by selectively transmitting gas from the gas inlet line to the jet line by gas lift valve at at least one point above the flared open end of the jet line to aerate liquid within the jet line.

33. A method of drilling an underwater well as defined in claim 28 further comprising the step of further controlling the buoyancy of the riser tube and its contents by selectively adding liquid to the generally annular region.

34. A method of drilling an underwater well as defined in claim 28 further comprising the steps of:

(a) providing at least one gas lift valve connecting the gas inlet line with the jet line above the flared open end of the jet line; and (b) further controlling the buoyancy of the riser tube and its contents by selectively transmitting gas from the gas inlet line to the jet line by gas lift valve at at least one point above the flared open end of the jet line to aerate liquid within the jet line.

* * * * *

UNITED STATES PATENT AND TRADEMARK OFFICE

CERTIFICATE OF CORRECTION

PATENT NO. : 4,081,039

DATED : March 28, 1978

INVENTOR(S) : Harold W. R. Wardlaw

It is certified that error appears in the above-identified patent and that said Letters Patent are hereby corrected as shown below:

In Claim 23, line 45, after the word "and", insert the word --out--.

In Claim 29, line 13, delete the word "small" and insert therefor --smaller--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*